US009373888B1

(12) United States Patent
Schuss et al.

(10) Patent No.: US 9,373,888 B1
(45) Date of Patent: Jun. 21, 2016

(54) METHOD AND APPARATUS FOR REDUCING SIDELOBES IN LARGE PHASED ARRAY RADAR WITH SUPER-ELEMENTS

(71) Applicant: Raytheon Company, Waltham, MA (US)

(72) Inventors: Jack J. Schuss, Newton, MA (US); Kaichiang Chang, Northborough, MA (US); Jeffrey C. Upton, Groton, MA (US)

(73) Assignee: Raytheon Company, Waltham, MA (US)

( * ) Notice: Subject to any disclaimer, the term of this patent is extended or adjusted under 35 U.S.C. 154(b) by 267 days.

(21) Appl. No.: 13/945,197

(22) Filed: Jul. 18, 2013

Related U.S. Application Data

(63) Continuation of application No. 12/635,893, filed on Dec. 11, 2009, now abandoned.

(60) Provisional application No. 61/163,266, filed on Mar. 25, 2009.

(51) Int. Cl.
*H01Q 3/00* (2006.01)
*H01Q 3/26* (2006.01)

(52) U.S. Cl.
CPC ..... *H01Q 3/26* (2013.01)

(58) Field of Classification Search
CPC ..... H01Q 3/00
USPC ..... 342/368, 372
See application file for complete search history.

(56) References Cited

U.S. PATENT DOCUMENTS

| | | | | |
|---|---|---|---|---|
| 3,021,521 | A | 2/1962 | Hutchins | |
| 4,197,540 | A | 4/1980 | Riggs et al. | |
| 4,216,472 | A | 8/1980 | Albanese | |
| 4,970,519 | A | 11/1990 | Minnis et al. | |
| 5,343,211 | A * | 8/1994 | Kott | H01Q 3/2611 342/379 |
| 5,646,625 | A | 7/1997 | Burrier | |
| 5,911,692 | A | 6/1999 | Hussain et al. | |
| 5,966,048 | A | 10/1999 | Thompson | |
| 6,043,791 | A * | 3/2000 | Kinsey | H01Q 3/26 343/754 |
| 6,078,289 | A * | 6/2000 | Manoogian | H01Q 21/22 342/373 |
| 6,218,987 | B1 | 4/2001 | Derneryd et al. | |
| 6,279,399 | B1 * | 8/2001 | Holm | G10K 11/341 73/626 |
| 6,496,158 | B1 | 12/2002 | Ksienski et al. | |
| 6,507,315 | B2 | 1/2003 | Purdy et al. | |
| 6,621,470 | B1 * | 9/2003 | Boeringer | H01Q 21/22 343/700 MS |
| 6,799,014 | B2 | 9/2004 | Rosen et al. | |
| 6,856,284 | B1 | 2/2005 | Cangiani | |
| 6,933,878 | B1 | 8/2005 | Molyneux-Berry | |

(Continued)

OTHER PUBLICATIONS

Notice of Allowance in U.S. Appl. No. 13/826,926 dated Aug. 19, 2013, 11 pages.

(Continued)

*Primary Examiner* — Harry Liu
(74) *Attorney, Agent, or Firm* — Daly, Crowley, Mofford & Durkee, LLP

(57) ABSTRACT

Methods and apparatus for a phased array radar system including an array comprising columns of super-elements containing radiator elements located along a length of the super-element, wherein the super-elements form the columns such that super-elements are arranged end-to-end, wherein the super-elements are arranged in the column at randomized locations to reduce sidelobes. In a further embodiment, super element lengths can be randomized.

13 Claims, 19 Drawing Sheets

(56) References Cited

U.S. PATENT DOCUMENTS

| | | | | |
|---|---|---|---|---|
| 6,963,312 | B2 | 11/2005 | Schuneman et al. | |
| 7,180,457 | B2 | 2/2007 | Trott et al. | |
| 7,474,262 | B2 * | 1/2009 | Alland | G01S 7/288 342/101 |
| 7,477,921 | B2 | 1/2009 | Shattil | |
| 7,492,313 | B1 | 2/2009 | Ehret et al. | |
| 7,517,317 | B2 * | 4/2009 | Lazenby | G01S 15/8925 600/447 |
| 7,538,564 | B2 | 5/2009 | Ehrmann et al. | |
| 7,808,427 | B1 | 10/2010 | Sarcione et al. | |
| 2005/0012665 | A1 * | 1/2005 | Runyon | H01Q 1/246 342/372 |
| 2006/0164284 | A1 * | 7/2006 | Pauplis | G01S 7/2813 342/16 |
| 2008/0204318 | A1 | 8/2008 | Thomas et al. | |
| 2008/0272959 | A1 | 11/2008 | Meharry et al. | |
| 2009/0002249 | A1 * | 1/2009 | Bloss | H01Q 3/08 343/758 |
| 2012/0319900 | A1 | 12/2012 | Johansson et al. | |

OTHER PUBLICATIONS

U.S. Appl. No. 13/550,890 Notice of Allowance dated Sep. 2, 2014, 16 pages.
U.S. Appl. No. 13/329,682 Response to Office Action filed on Sep. 2, 2014, 8 pages.
Office Action in U.S. Appl. No. 13/826,926 dated Dec. 27, 2013, 9 pages.
U.S. Appl. No. 13/329,682 Office Action dated Mar. 31, 2014, 11 pages.
U.S. Appl. No. 13/826,926 Response filed on Jun. 25, 2014 7 pages.
U.S. Appl. No. 13/826,926 Notice of Allowance dated Mar. 14, 2013 6 pages.
Office Action dated Jul. 31, 2014 for U.S. Appl. No. 13/331,334, filed Dec. 20, 2011 20 pages.
U.S. Appl. No. 12/635,893, filed Dec. 11, 2009, Schuss et al.
Notice of Allowance dated Dec. 16, 2011, U.S. Appl. No. 12/466,066.
Office Action in U.S. Appl. No. 12/835,893 dated Aug. 26, 2011, 6 pages.
Response to Office Action in U.S. Appl. No. 12/635,893 dated Aug. 26, 2011, filed on Nov. 21, 2011, 9 pages.
Notice of Allowance dated Dec. 7, 2011, U.S. Appl. No. 12/636,893, 5 pages.
RCE and Amendment filed Mar. 6, 2012 in U.S. Appl. No. 12/635,893, 7 pages.
Office Acton in U.S. Appl. No. 12/635,893 dated Mar. 15, 2012, 6 pages.
Response to Office Action in U.S. Appl. No. 12/635,893 dated Mar. 15, 2012, filed on Aug. 14, 2012, 4 pages.
Office Action in U.S. Appl. No. 12/635,893 dated Oct. 10, 2012, 5 pages.
Response to Office Action in U.S. Appl. No. 12/635,893 dated Oct. 10, 2012, filed on Apr 9, 2013, 6 pages.
Notice of Allowance in U.S. Appl. No. 12/635,893 dated Apr. 19, 2013, 6 pages.
Office Action in U.S. Appl. No. 12/730,533 dated Jun. 7, 2012, 6 pages.
Response to Office Action in U.S. Appl. No. 12/730,533 dated Jun. 7, 2012, filed Jul. 9, 2012, 1 page.
Notice of Allowance in U.S. Appl. No. 12/730,533 dated Aug. 1, 2012, 8 pages.

* cited by examiner

Layer Stack Up Dimensions

| Layer | Material | Thick (in.) | $\varepsilon_r$ | $\delta_d$ |
|---|---|---|---|---|
| 1 | Foam (Roh 71) | 0.317 | 1.08 | 0.0003 |
| 2 | Adhesive | 0.005 | 2.2 | 0.002 |
| 3 | Taconic RF-43 | 0.01 | 4.3 | 0.0033 |
| 4 | Adhesive | 0.005 | 2.2 | 0.002 |
| 5 | Foam (Roh 71) | 0.26 | 1.08 | 0.0003 |
| 6 | Adhesive | 0.005 | 2.2 | 0.002 |
| 7 | Taconic RF-43 | 4.3 | 4.3 | 0.0033 |

410 — Lower Patch Width: 0.857
412 — Upper Patch Width: 0.3
Patch Thickness 0.0007
} Lower Patch Strip on Bottom of Layer 3
Upper Patch Strip on Top of Layer 7

METHOD AND APPARATUS FOR REDUCING SIDELOBES IN LARGE PHASED ARRAY RADAR WITH SUPER-ELEMENTS

CROSS REFERENCE TO RELATED APPLICATIONS

The present application is a continuation of application Ser. No. 12/635,893, filed on Dec. 11, 2009, which claims the benefit of U.S. Provisional Patent Application No. 61/163,266, filed on Mar. 25, 2009, which are both incorporated herein by reference.

BACKGROUND

As is known in the art, phased array radars have a number of advantages over other types of radar systems while having certain potential disadvantages, such as high cost and complexity. One issue that may arise in very large limited scan phased arrays is the increase in peak sidelobe levels due to amplitude taper quantization effects and the grating lobes of a super-element lattice driven by finite instantaneous bandwidth. Grating lobes can also be driven by the super-element non-uniform illumination taper. As is known in the art, super-elements contain a number of radiating elements coupled to a common transmission line or RF feed. This can be realized in a number of topologies, including configurations of waveguides with slot radiators, configurations of radiators fed by stripline feeds, and configurations of oversized ($>\lambda/2$) waveguide radiators. Another issue with increasing the length of super-elements is an increase in scan loss, or a reduction in scan volume due to the larger size super-elements.

SUMMARY

The present invention provides methods and apparatus for a phased array radar having columns of super-element array radiators that are randomized with respect to location along the column length. In one particular embodiment, each column includes regularly spaced super-elements, and each column is offset from its adjacent columns in the direction of the column by a random distance. With this arrangement, sidelobes can be suppressed without the need to implement multiple size super-elements or subarrays and without the need to further reduce super-element size and increase array costs. In another embodiment, super-element radiators include randomization of super-element length by a predetermined amount, such as ten percent. Randomizing super-element location has minimal effect on array cost and no effect on the array electronics and/or beamformer.

In one aspect of the invention, a phased array radar system comprises: an array comprising columns of super-elements containing radiator elements located along a length of the super-element, wherein the super-elements form the columns such that super-elements are arranged end-to-end, wherein the super-elements are arranged in the column at randomized locations to reduce sidelobes.

The system can further include one or more of the following features: the super-element length is constant for at least part of the array, the column-to-column spacing is constant for at least part of the array, the array is elliptically symmetric, the length of the super-elements is randomized, the length of the super-elements is randomized to a selected granularity, and the length of a first super-element is selected and a length of a second super-element is varied by a first amount added or subtracted from the length of the first super-element, In another aspect of the invention, a phased array radar system comprises: an array comprising columns of super-elements containing radiator elements located along a length of the super-element, wherein the super-elements form the columns such that the super-elements are arranged end-to-end, wherein the length of the super-elements is randomized to reduce sidelobes.

In a further aspect of the invention, a method comprises providing an array including columns of super-elements containing radiator elements located along a length of the super-element, wherein the super-elements form the columns such that super-elements are arranged end-to-end, and arranging the super-elements the columns at randomized locations to reduce sidelobes.

The method can further include one or more of the following features: the super-element length is constant for at least part of the array, the column-to-column spacing is constant for at least part of the array, the array is elliptically symmetric, the length of the super-elements is randomized, the length of the super-elements is randomized to a selected granularity, and the length of a first super-element is selected and a length of a second super-element is varied by a first amount added or subtracted from the length of the first super-element.

BRIEF DESCRIPTION OF THE DRAWINGS

The foregoing features of this invention, as well as the invention itself, may be more fully understood from the following description of the drawings in which.

DETAILED DESCRIPTION

Figure 1:
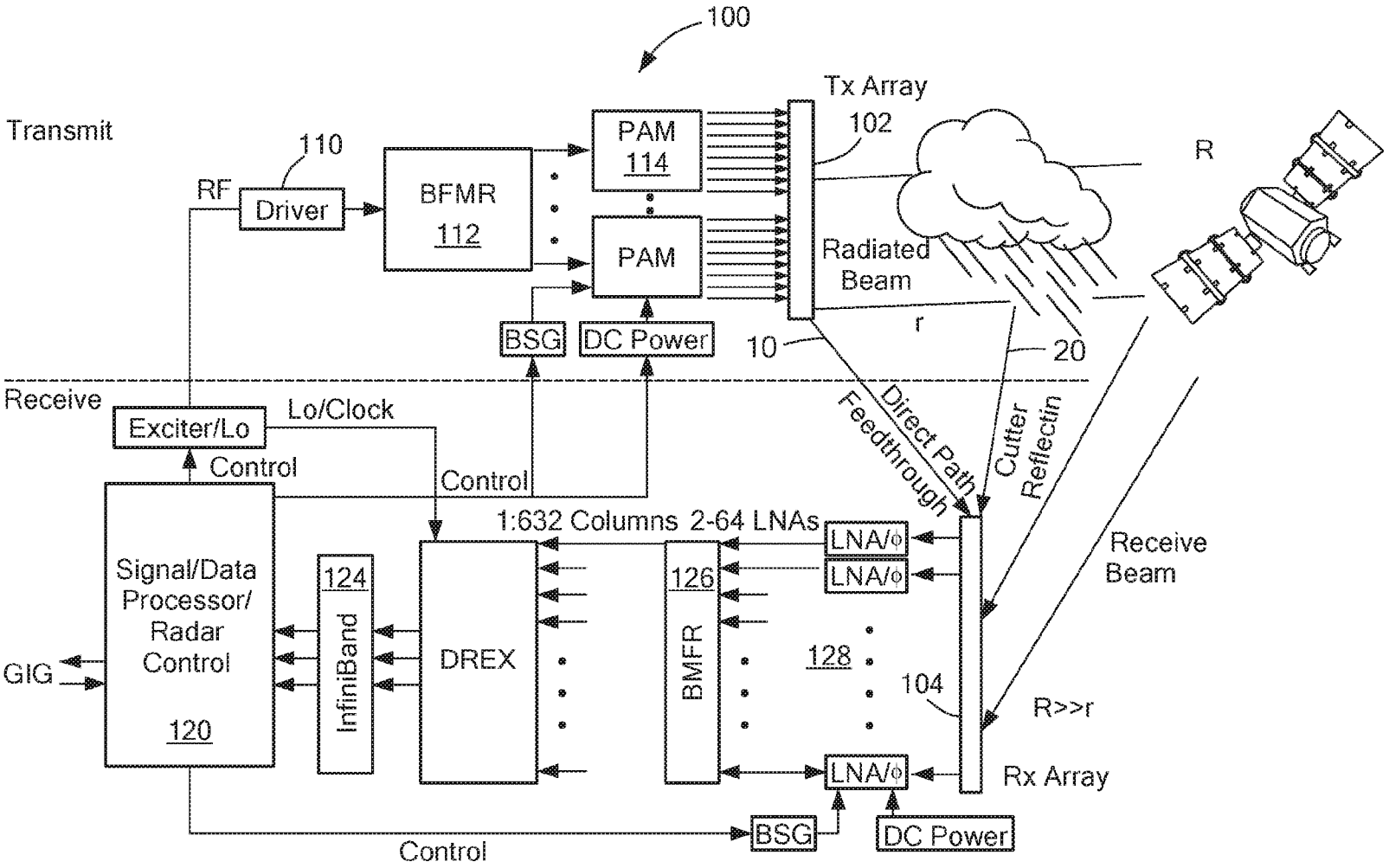
FIG. 1 shows an exemplary phased array radar system having super-elements with radiator elements in accordance with exemplary embodiments of the invention.

FIG. 1 shows an exemplary phased array radar system 100 including super-element radiators having randomized location in super-element columns in accordance with exemplary embodiments of the present invention. In one embodiment, the radar system is optimized for tracking satellite targets. The phased array radar 100 has separate transmit and receive arrays 102, 104 with a remote target illustrating direct path feedthrough 10 and feedthrough 20 from a near object in the form of a weather formation. The system 100 includes on the transmit side a driver 110 coupled to a digital beamformer 112 feeding a PAM (Power Amplifier Module) 114, which energizes the transmit array 102. The receive side includes a signal data processor control module 120 coupled to a digital receive system 122 via a universal I/O device 124, such as InfiniBand. The receive beamformer 126 receives input from the low noise amplifiers 128, which are coupled to the receive array 104.

In an exemplary embodiment, the transmit aperture 102 and separate receive aperture 104 are sized to enable the radar system to track targets from 100 km to 42,000 km in altitude. In one particular embodiment, the system includes a transmit aperture of about 200 m by 14 m and a receive aperture of about 215 m by 27 m, both of which can be elliptical. The challenges associated with a phased array of this size in performance, cost, module count, and complexity, will be readily apparent to one of ordinary skill in the art.

Figure 1A:
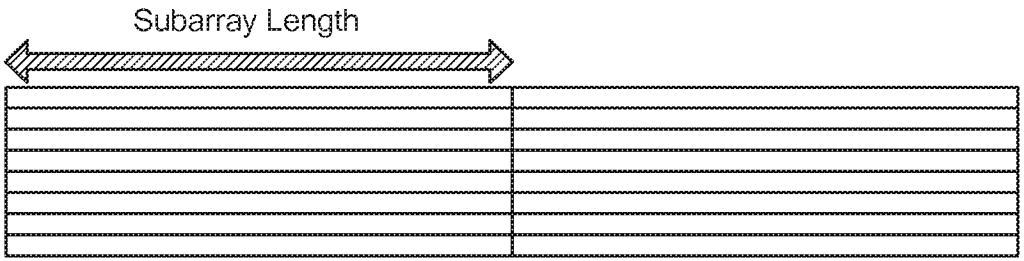
FIG. 1A is a pictorial representation of super-element columns in an array with super-elements aligned.
Figure 1B:
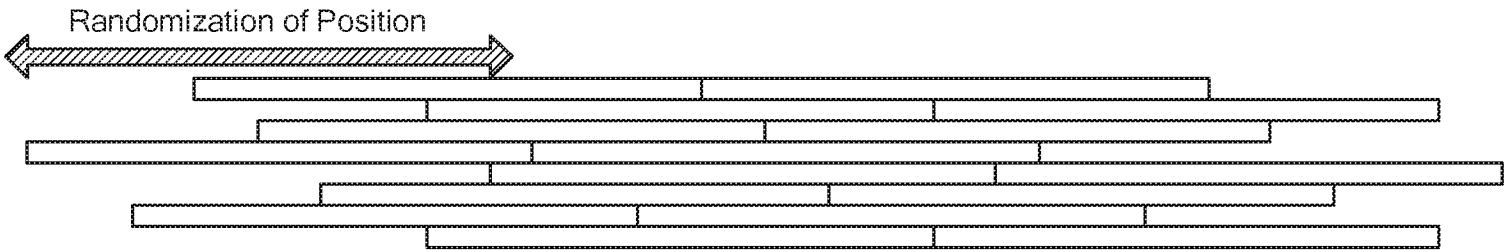
FIG. 1B is a pictorial representation of super-element columns in an array with super-element location randomized.

FIG. 1A shows a series of super-elements/subarrays SE arranged at regular intervals for form a symmetrical arrangement that can result in unacceptable sidelobe levels. FIG. 1B shows an exemplary arrangement of super-elements/subarrays SE making up a portion of an antenna aperture randomized in position along length in accordance with exemplary embodiments of the invention. As discussed in detail below, randomization of the super-elements significantly reduces sidelobe levels and enhances array performance with minimal impact on cost of manufacture and complexity of operation.

Before describing in detail exemplary embodiments of the inventive super-element radiator location randomization to reduce sidelobes, some information is provided. As is known in the art, a super-element radiator comprises a number of individual radiator elements coupled to a common transmission line.

Figure 2:
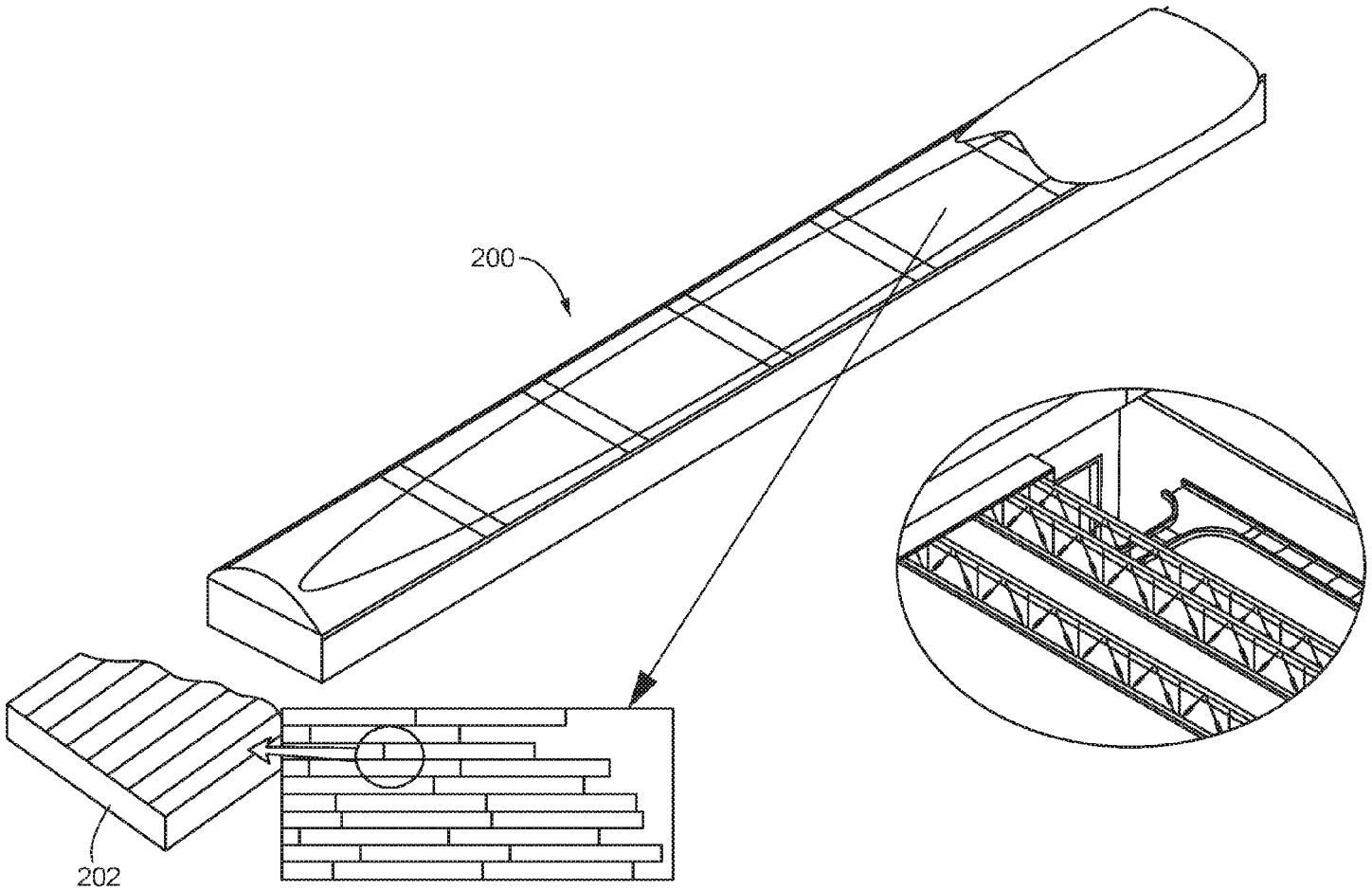
FIG. 2 is a pictorial representation of a super-element forming a part of an antenna aperture.

FIG. 2 shows an array implementation using exemplary embodiments of the super-element radiator array. An array 200 includes a number of super-element radiators 202 having a number of radiator elements. The array uses a frequency-scanned super-element approach that provides significant benefits.

Figure 3:
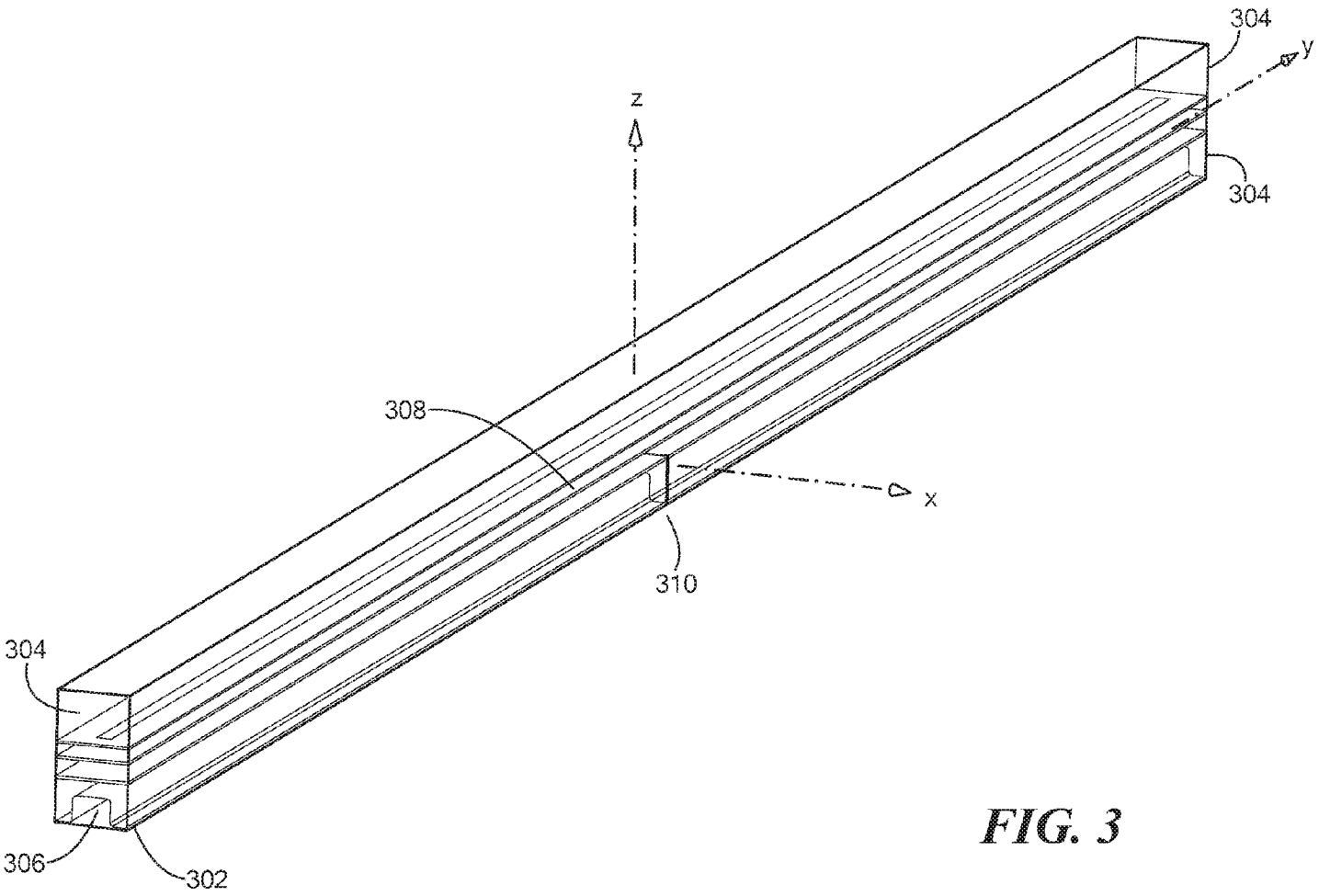
FIG. 3 is a diagrammatic representation of a super-element.
Figure 4:
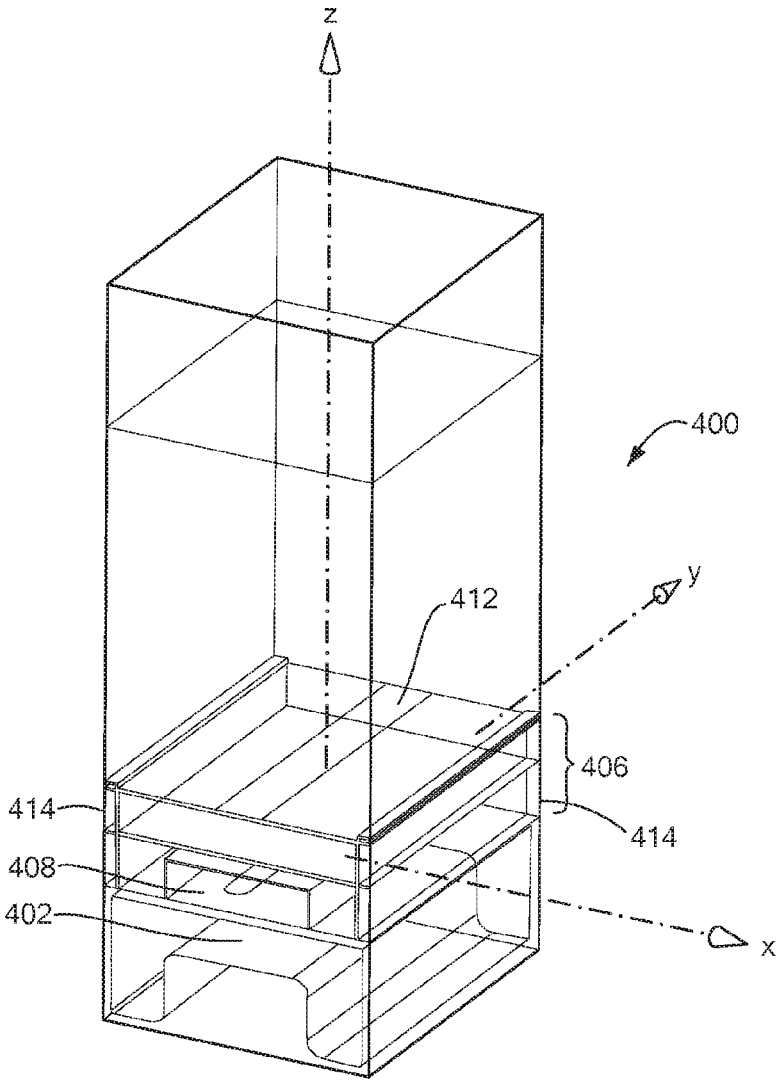
FIG. 4 is a depiction in model form of a unit cell of a super-element.

FIG. 3 shows an exemplary super-element radiator 300 and FIG. 4 shows a unit cell 400 in the super-element. The super-element 300 includes an input port 302 and a termination port 304. Radiation boundaries 305 are disposed in the xz plane above a ridged waveguide 306 that extends along an axis of the super-element. Master/slave walls 308 are located on the sides in yz plane above the waveguide 306. Note that a split 310 in the waveguide is shown for modeling purposes to help the meshing process.

Figure 5A:
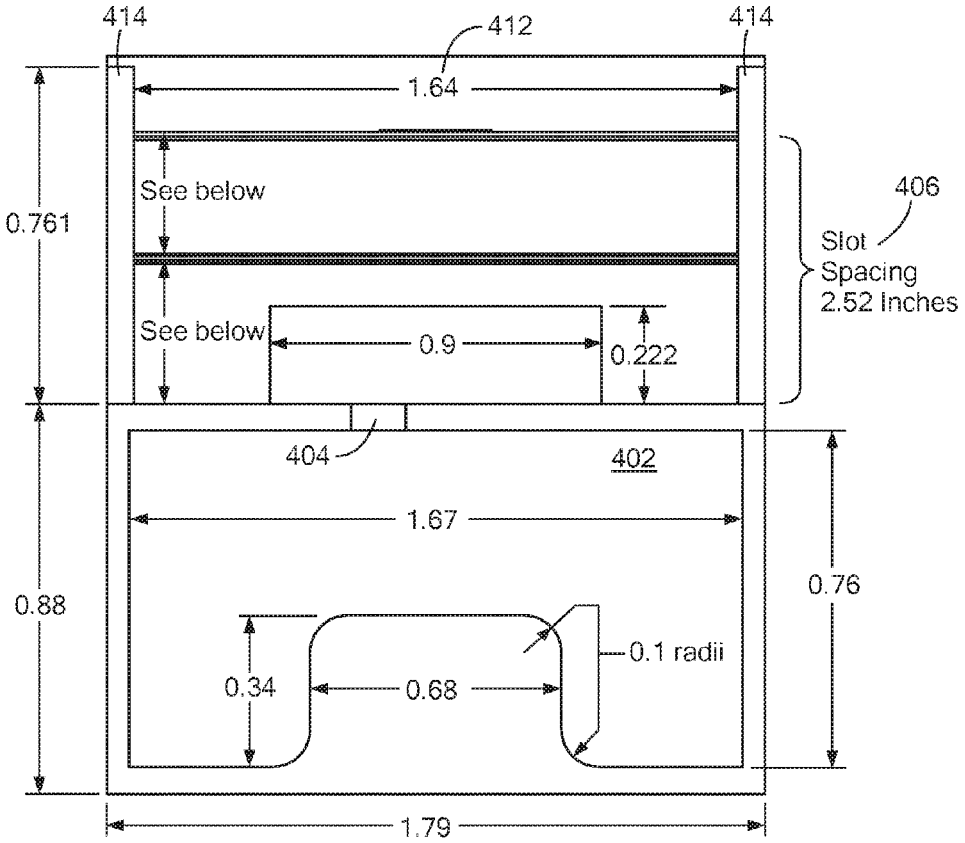
FIG. 5A is a cross-sectional view of a super-element and FIG. SB is a top view of a portion of a super-element.
Figure 5B:
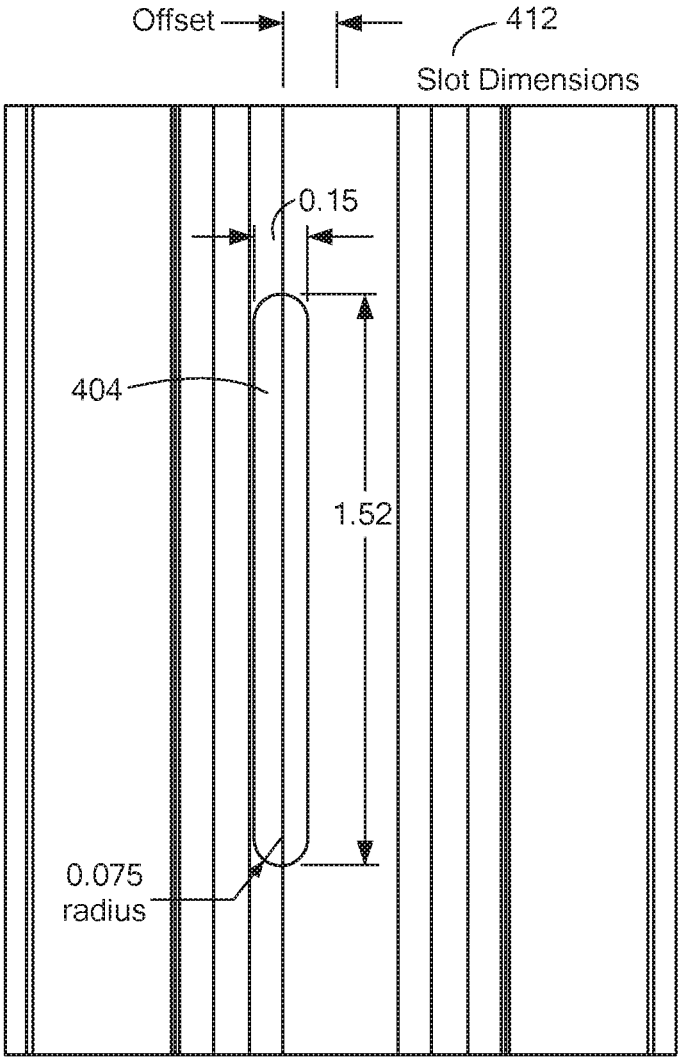

FIG. 4 shows some further detail for a unit cell 400 of the radiator. The unit cell includes a single ridge waveguide 402, which is well known in the art. With a feed port at one end of the super-element and a termination at the other end, the super-element acts as a transmission line distributing electromagnetic power to each of the unit cells. The upper conductive wall of the waveguide is interrupted with a slot coupler 404 (see FIG. 6A). A dielectric assembly 406 is disposed over the waveguide 402. In an exemplary embodiment, the dielectric assembly includes a channel 408 and a layer stack shown in detail in FIG. 5, which shows exemplary dimensions for the unit cell 400. The dielectric assembly includes first (shown in FIG. 5) and second conductive strips or patches 410, 412 located at first and second heights above the coupling slot 404. The resonant conductive strips 410, 412 are suspended with low loss foam dielectric materials in a single sub-assembly. In an exemplary embodiment, the strips 410, 412 are continuous over the full length of the super-element. Conductive walls 414 enclose the dielectric and strip subassembly, also running the full length of the super-element. The conductive walls 414 form a long slot radiator, with an opening extending the full length of the super-element. As shown in FIG. 5, the coupler 404 is approximately 1.52 inches long, 0.15 inches wide, with semi-circular ends, and is cut out of the full height of the upper waveguide wall.

Figure 6A:
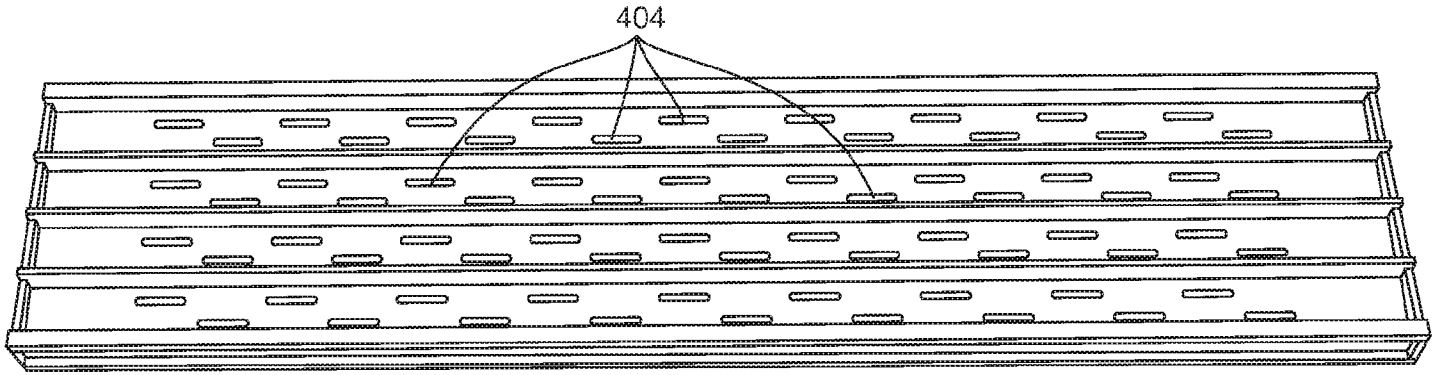
FIGS. 6A-D show a pictorial representation of a super-element assembly with FIG. 6B showing the super-element with a form core assembly.
Figure 6B:
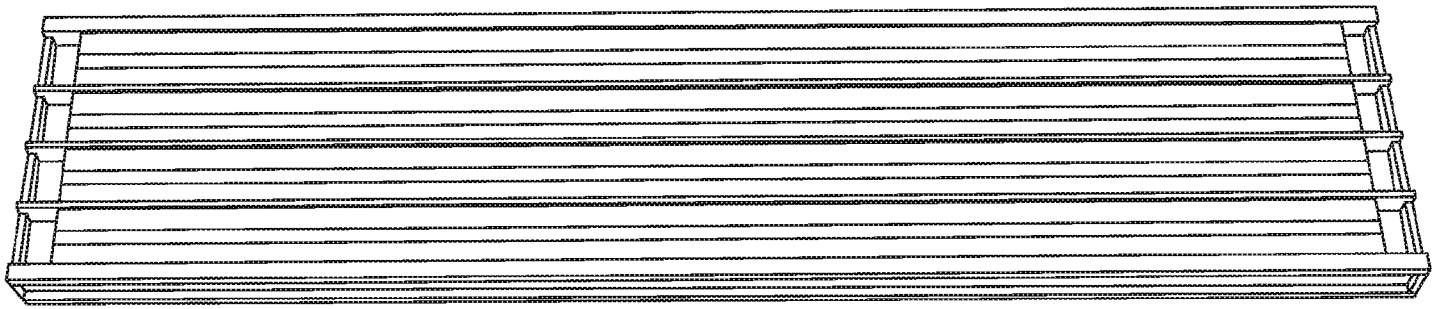
Figure 6C:
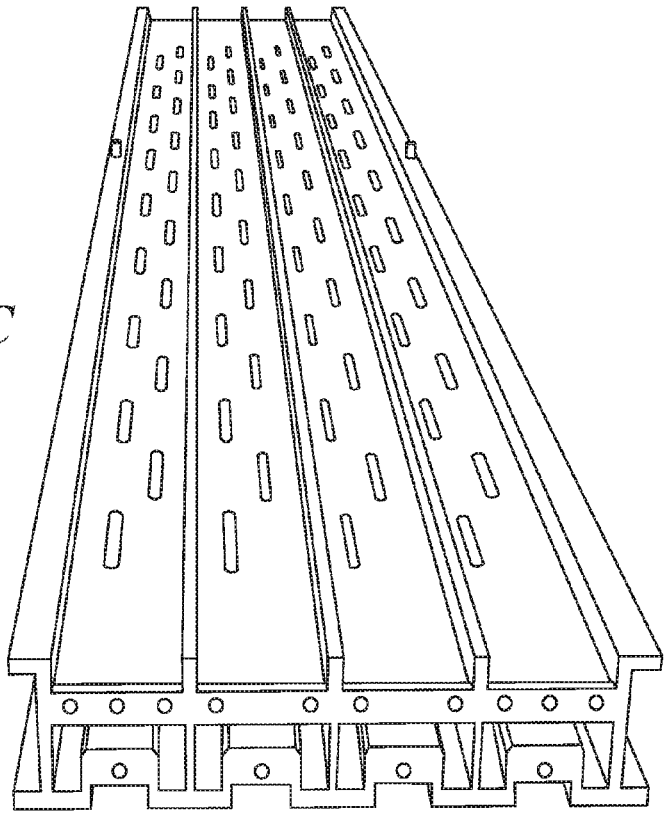
Figure 6D:
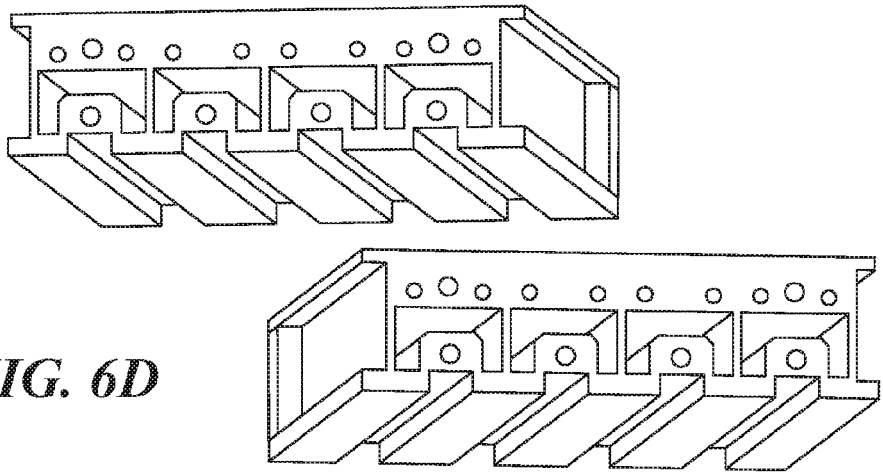

FIGS. 6A-D show pictorial representations of super-element radiators in accordance with exemplary embodiments of the invention. FIGS. 6A, 6C, and 6D show the super-element assembly without the dielectric assembly. FIG. 6B shows the super-element assembly with dielectric/foam core assemblies. FIG. 6D shows an exemplary coax to waveguide transmission. It is understood that any suitable transition to waveguide can be used.

In an exemplary large radar aperture, super-elements are formed from slotted waveguide arrays, which are spaced side-to-side by approximately $\lambda/2$, but which have a length much greater than $\lambda$ (wavelength). In this long dimension, grating lobes appear in the far field patterns due to quantization effects in the aperture taper. A uniform illumination along each super-element is assumed. Also, as the array is scanned, grating lobes can be formed when the instantaneous frequency is different than the frequency at which the array is steered. Since the latter effect may be larger than the former, focus is directed to these frequency-driven grating lobes or sidelobes and non-uniform illumination taper.

Figure 7:
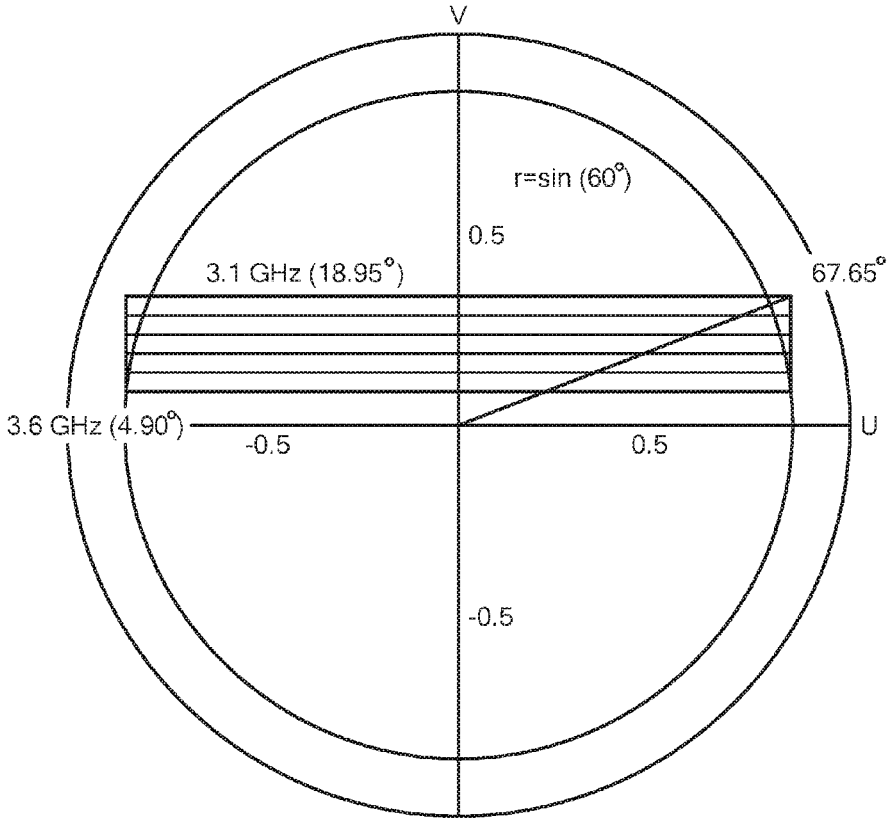
FIG. 7 is a sine space representation for the angular coverage of a phase array radar.

For the illustrative slotted waveguide super-element, the pattern of each super-element scans with frequency. The array pattern, or array factor of super-elements, is formed by phase steering the super-elements so that its peak corresponds in u-v space to the peak of the super-element pattern. An exemplary sine space representation is shown in FIG. 7. The far field radiation can be scanned to locations along the v-axis by operating at the frequencies shown, so at 3.1 GHz, the beam is scanned to approximately 19 degrees from the surface normal. Independently, the beam may be scanned along the u-axis by adjusting its aperture phase state at the super-element ports. The total scan volume extends beyond a ring located 60 degrees from the aperture surface normal or what is often termed the antenna boresight. The resulting total scan volume represents a significant surveillance or coverage volume and is displaced from boresight (center) to avoid resonance effects at boresight scan. The combinations of operating frequency and phase scan are used to position the antenna beam as needed within the total scan volume.

While slotted waveguide super-elements are shown, it is understood that randomization of super-element features in accordance with exemplary embodiments of the invention is applicable to super-elements in general for which it is desirable to reduce sidelobes. For example, stripline fed super-element embodiments can include randomization in alternative embodiments of the invention.

Grating lobes appear when the array factor grating lobes stray off of the null in the super-element pattern. For an array of super-elements, the far field pattern can be expressed as $$V(k) = \frac{\sin((k-ko)dN/2) * \sin((k-kso)d/2)}{\sin((k-ko)d/2) * (k-kso)d/2} \quad \text{Eq. (1)}$$

where there are N super-elements in a column, each of length d>>λ, k=2π/λ*sin θ, where θ is the viewing angle along the column direction, ko is the k to which the array is scanned, and kso is the scan angle of the subarray. Element kso is a function of the instantaneous frequency f, whereas ko is fixed. For an instantaneous frequency f≠fo, ko≠kso. Equation 1 shows that when $$k=ko+/-2\pi/d \text{ and } f=fo, \quad \text{Eq. (2)}$$

the grating lobe of the array factor appears at the null of the super-element pattern. However, for f≠fo, the grating lobe moves off of the super-element pattern null, and a significant sidelobe can appear.

Equation 1 corresponds to FIG. 1A, where super-elements are spaced in a regular lattice. FIG. 1B shows randomization of the starting location of each column, leaving the column-to-column spacing and the super-element length d constant. This leads to modifying Equation 1 by multiplying by the factor $$F(k, ko) = \sum_{i=1}^{M} \exp(j(k-ko)d\delta_i) \quad \text{Eq. (3)}$$

where the sum is performed over M columns of the array, the starting position of column i is $d\delta_i$, and $\delta_i$ is a random number from 0 to 1. If one looks at the first array factor grating lobe that appears at k=ko+2π/d, the average of F is zero. The is value will be 1/M. There is no effect on the mainlobe of the array, and the grating lobe level is suppressed by 1/M.

Figure 8:
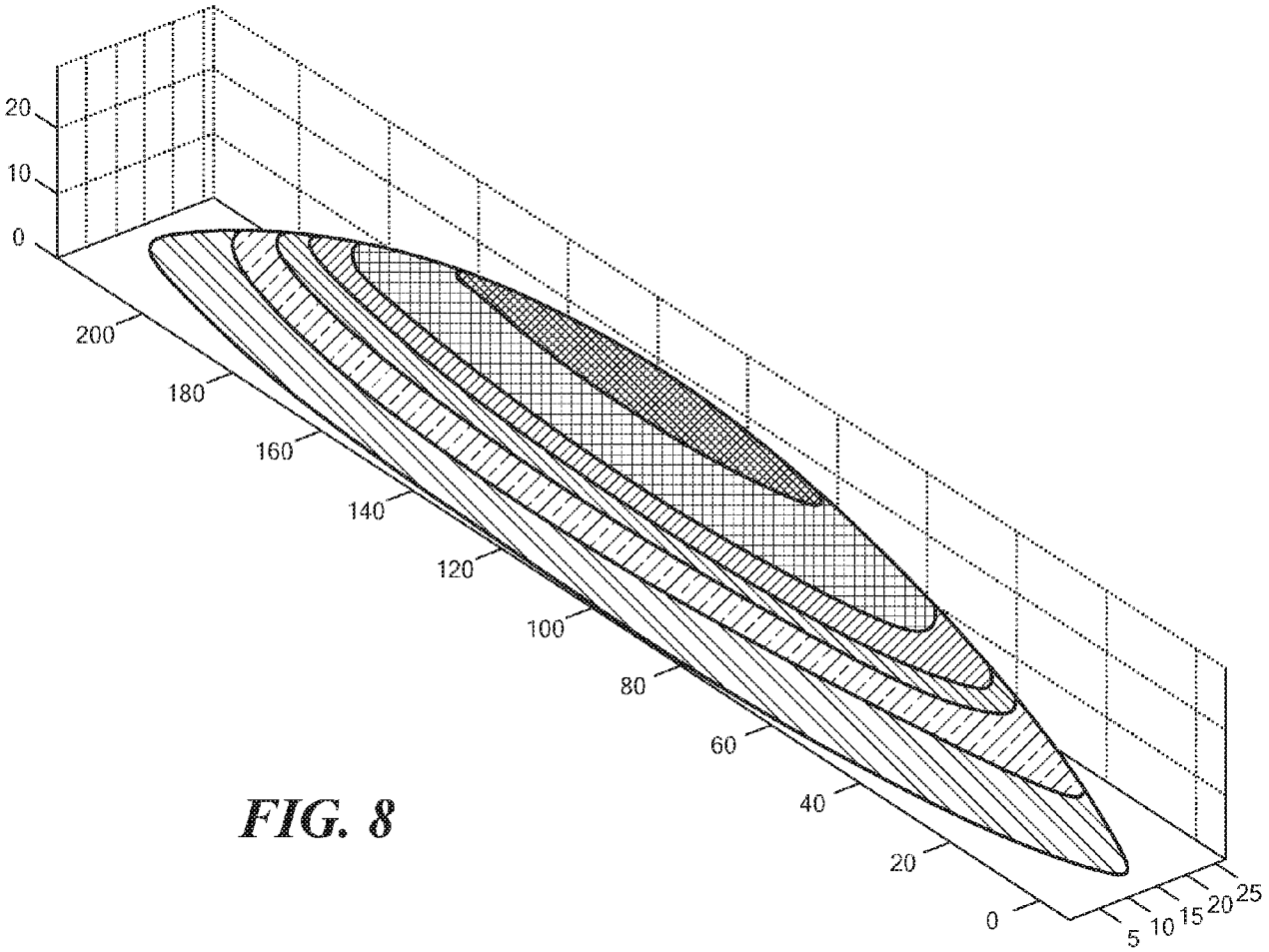
FIG. 8 is a representation of array illumination for rectangularly arranged super-elements that are arranged in a defined regular lattice.

FIG. 8 shows the amplitude illumination of a large elliptical array formed by 632 columns, the longest column including 32 super-elements/subarrays. The array length is 213 m and the width is 27 m. In this case, super-elements are spaced in a regular rectangular lattice, such as that shown in FIG. 1A.

Figure 9:
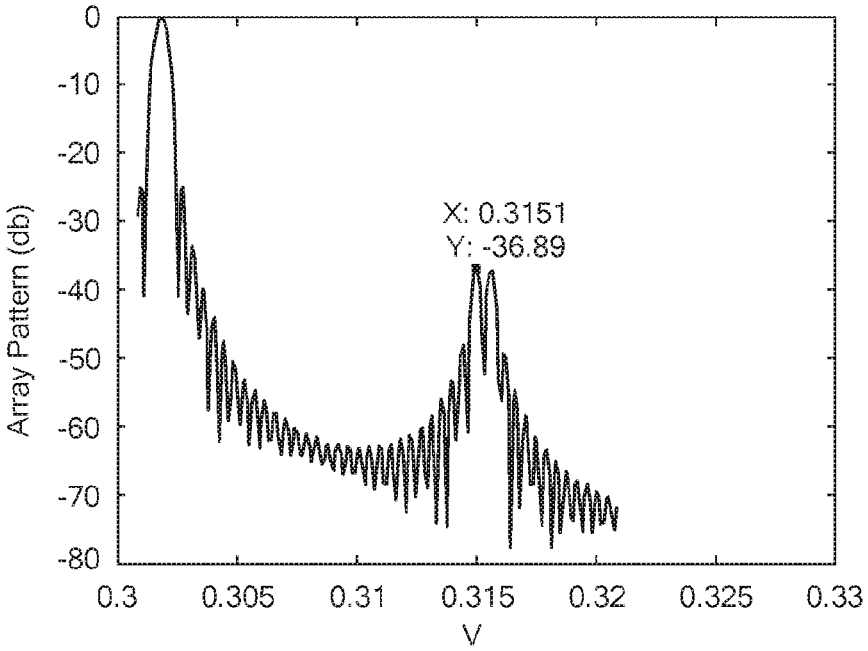
FIG. 9 is a graphical depiction of an array pattern for rectangularly arranged super-elements at regular locations at zero MHz offset.
Figure 10:
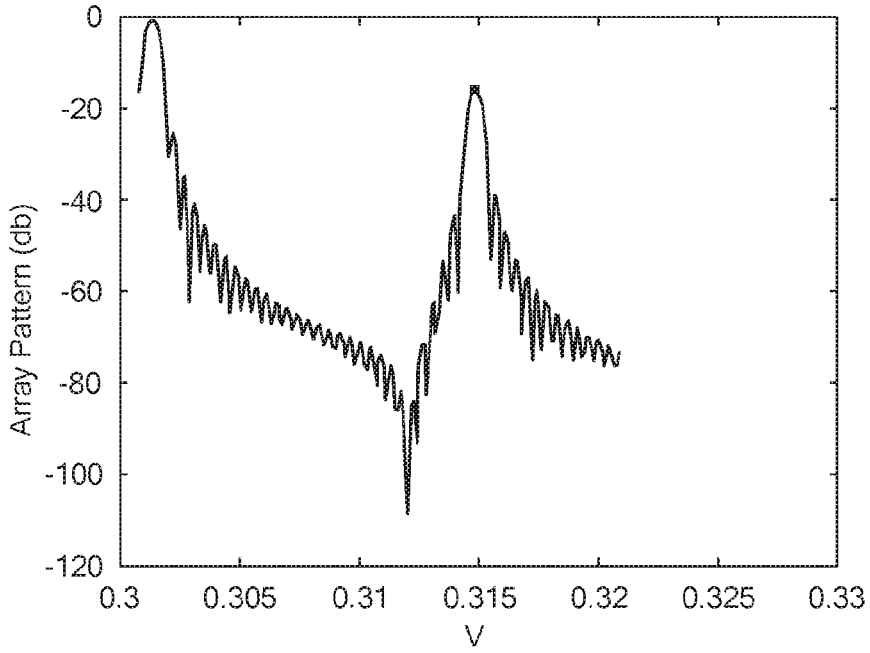
FIG. 10 is a graphical depiction of an array pattern for rectangularly arranged super-elements at regular locations at five MHz offset.

FIG. 9 shows the array pattern at f=fo, for the array of FIG. 8 and shows the bifurcation of the grating lobe by the super-element pattern. FIG. 10 shows the same pattern with f shifted from fo by 5 MHz, which increases the grating lobe to an unacceptable −16 db.

Figure 11:
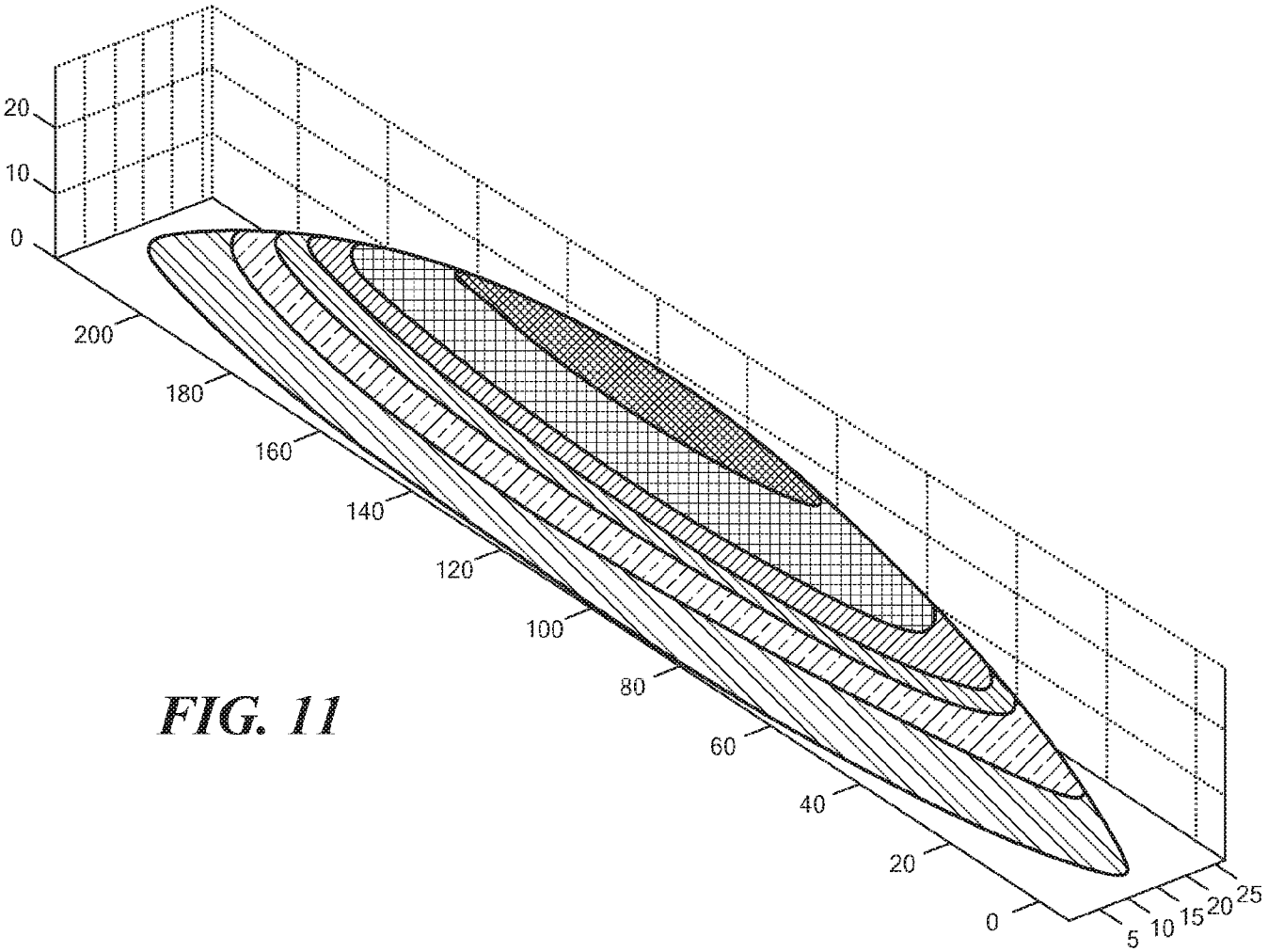
FIG. 11 is a representation of array illumination for rectangularly arranged super-elements where each column is offset from its adjacent columns in the direction of the column by a random distance.
Figure 12:
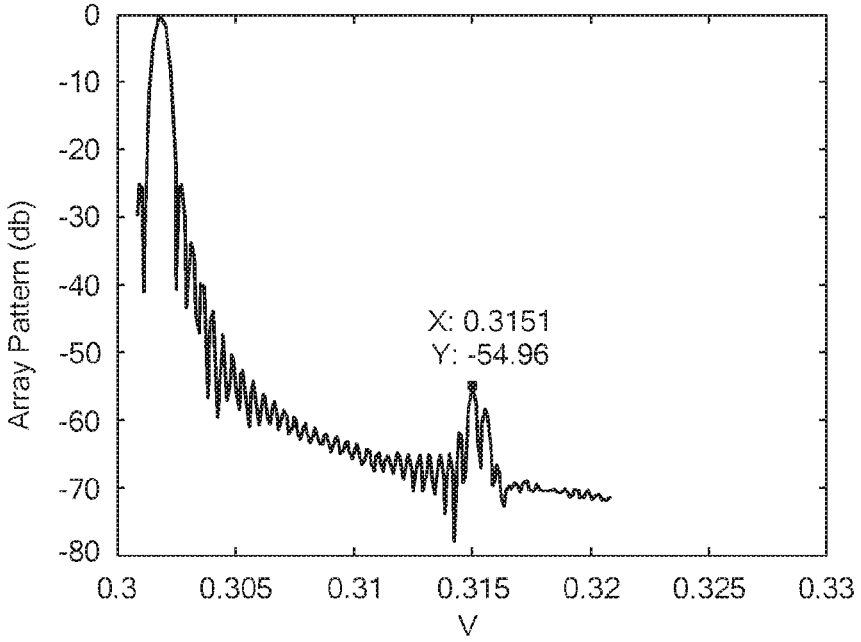
FIG. 12 is a graphical depiction of an array pattern for a rectangularly arranged super-elements with super-element location randomization at zero MHz offset.
Figure 13:
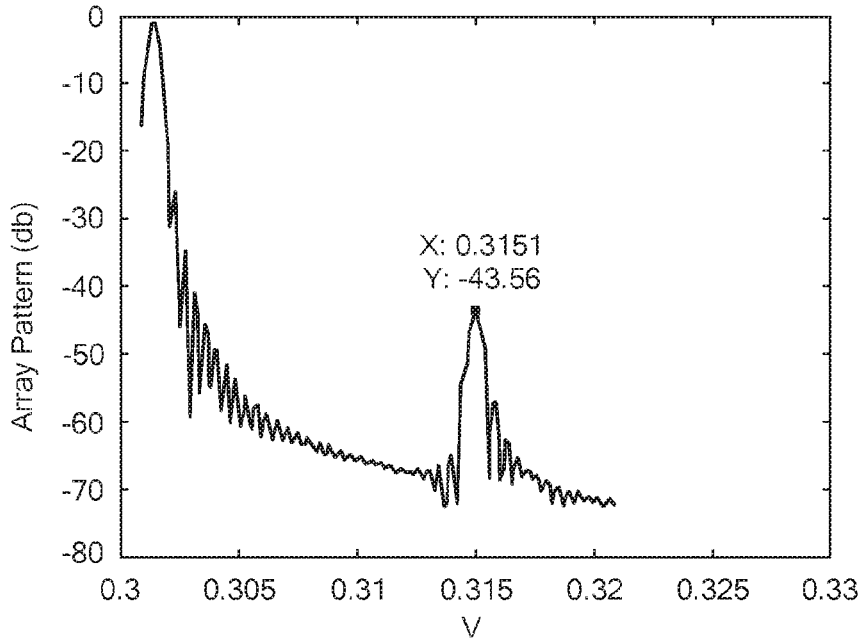
FIG. 13 is a graphical depiction of an array pattern for a rectangularly arranged super-elements with super-element location randomization at five MHz offset.

FIG. 11 shows the illumination for an array having super-element locations randomized per FIG. 1*b*. FIGS. 12 and 13 show the radiation patterns for f=fo, and for f shifted by 5 MHz, respectively. The improvement in the sidelobe levels is dramatic.

Figure 14:
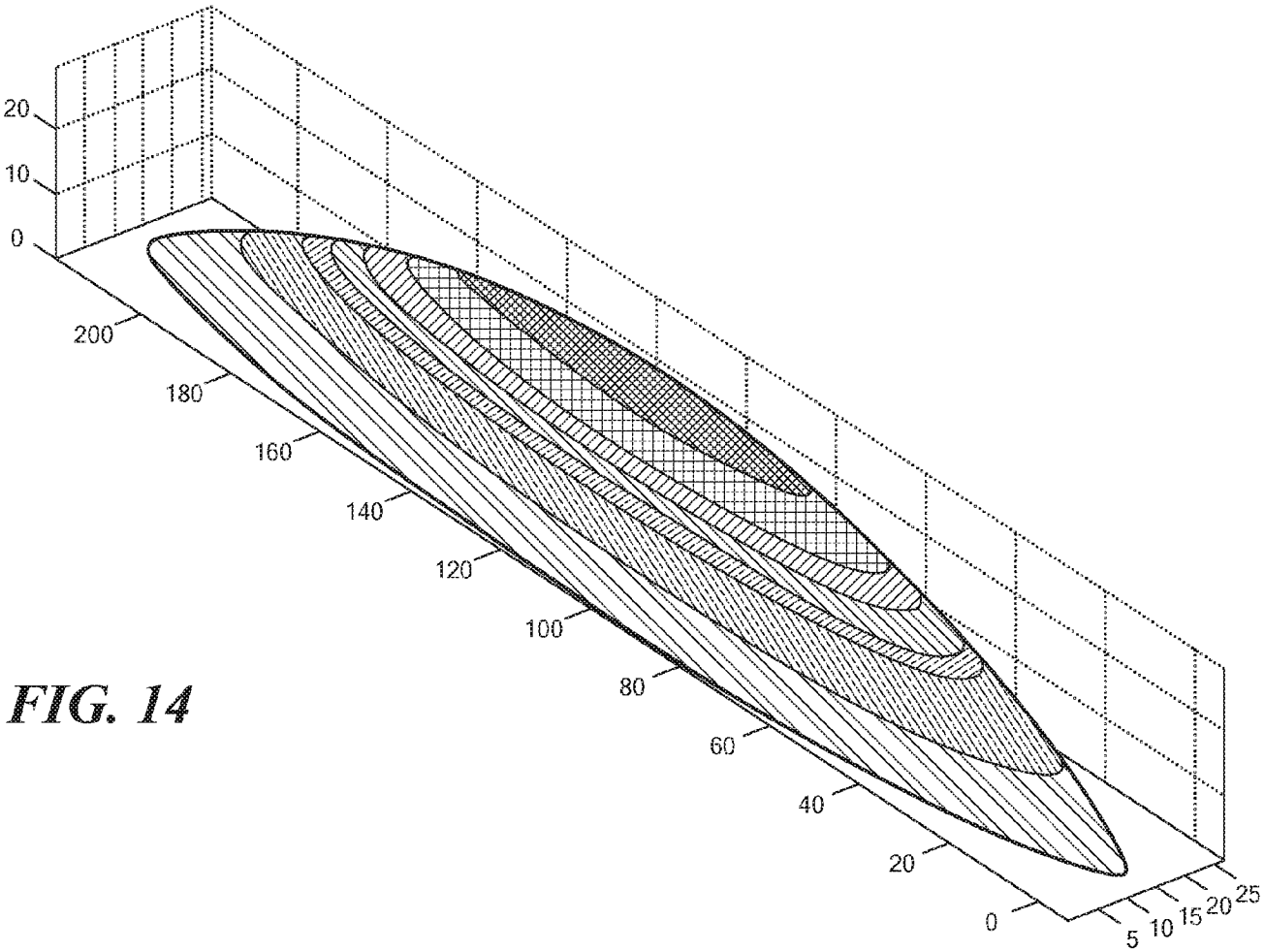
FIG. 14 is a representation of array illumination for elliptically arranged super-elements where each column is offset in the column direction so as to fit within the elliptical array boundary.
Figure 15:
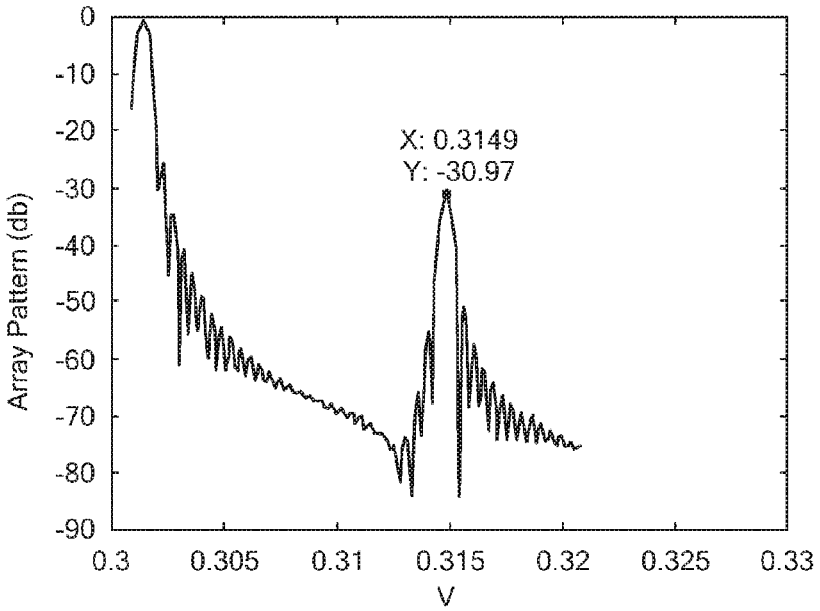
FIG. 15 is a graphical depiction of an array pattern for elliptically arranged super-elements that are aligned in the array columns at five MHz offset.

FIG. 14 shows the array illumination with super-elements arranged in an elliptically symmetric lattice. FIG. 15 shows the sidelobe level for f shifted from fo by 5 MHz for the arrangement of FIG. 14. There is a significant suppression of the grating lobe, but not as large as that in FIG. 13.

Figure 16:
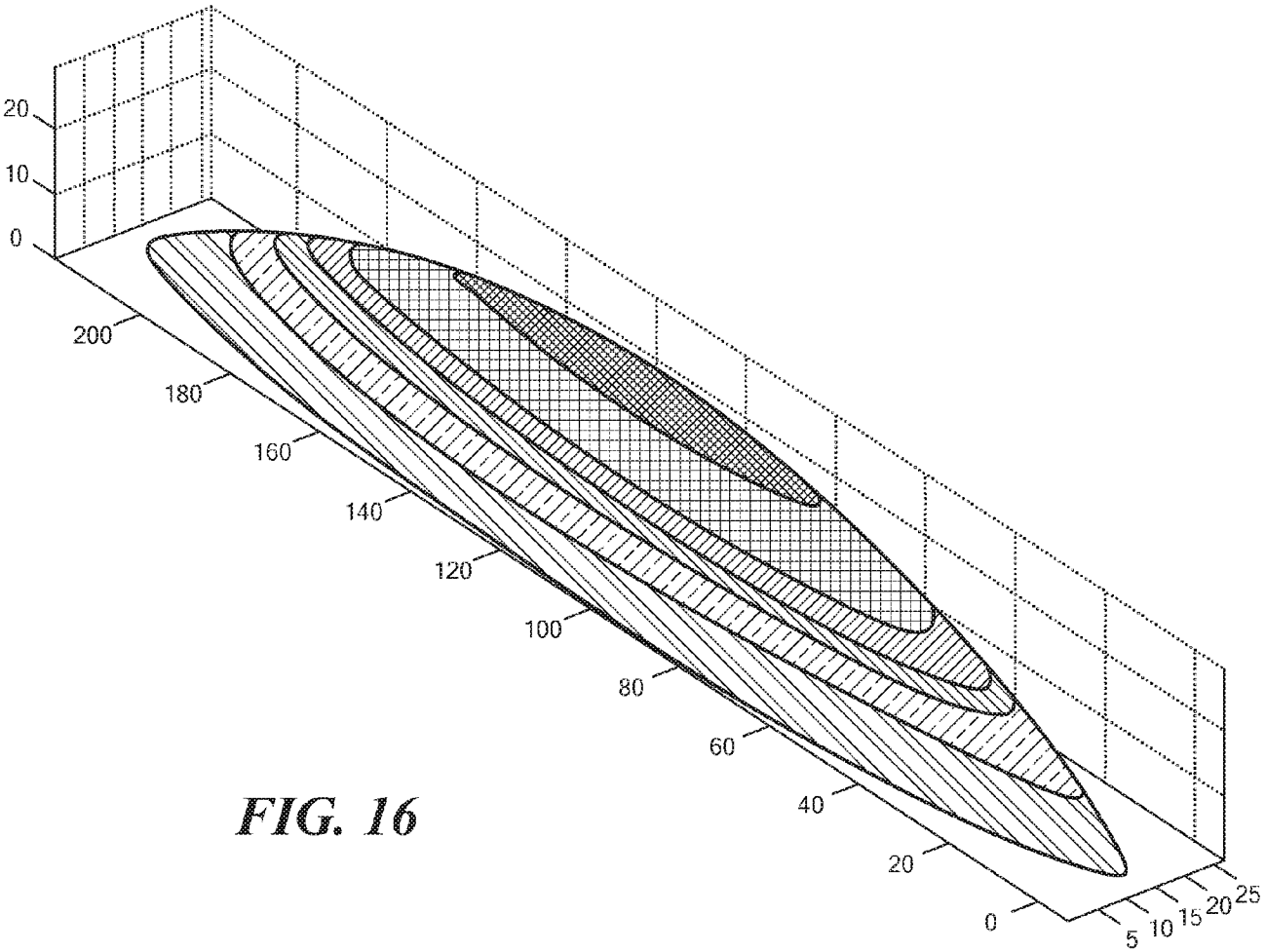
FIG. 16 is a representation of array illumination for elliptically arranged super-elements where each column is offset in the column direction so as to best fit within the elliptical array boundary, and additionally has its position in the column direction randomly offset from its adjacent columns.
Figure 17:
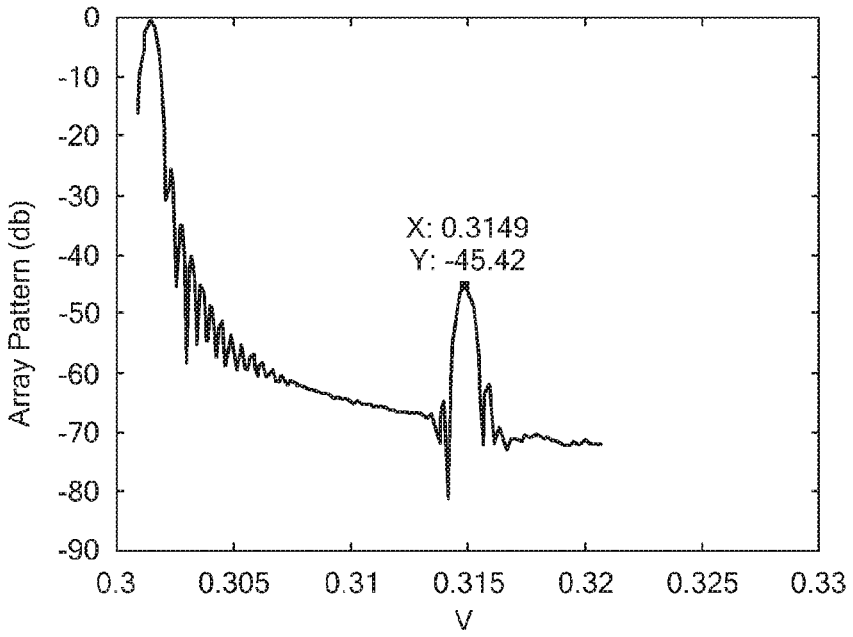
FIG. 17 is a graphical depiction of an array pattern for elliptically arranged super-elements with super-element location randomization at five MHz offset.
Figure 18:
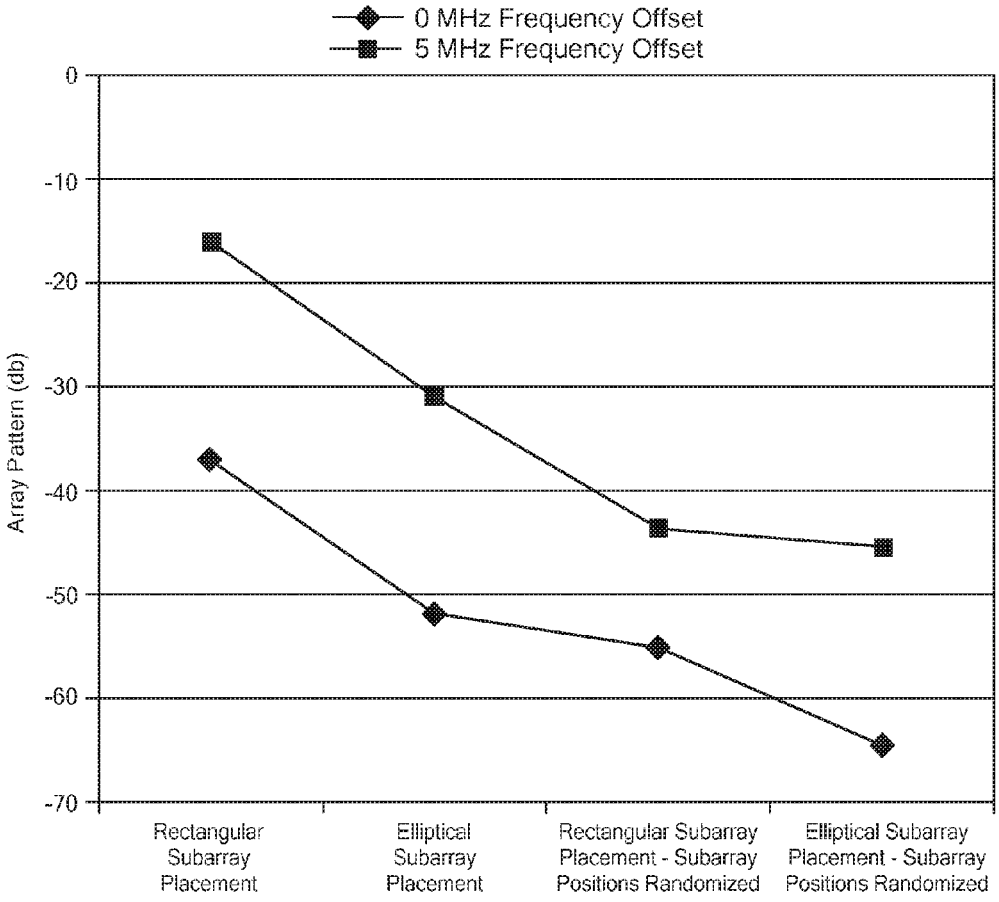
FIG. 18 is a graphical depiction of peak sidelobe amplitude at 0 MHz and 5 MHz frequency offsets for elliptically arrange and rectangularly arranged super-elements with and without super-element location randomization.

FIG. 16 is the same as FIG. 14, except that super-element positions are randomized. FIG. 17 shows the sidelobe level for f shifted from fo by 5 MHz. Here the grating lobe suppression is superior. FIG. 18 summarizes these results, and shows that enhanced sidelobe suppression is obtained for the elliptically symmetric super-element lattice if one uses randomized super-element positions. It is clear that the array can achieve a level of sidelobe suppression that is approximately equal to 1/M.

Figure 19:
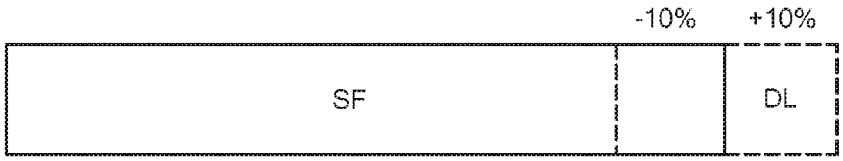
FIG. 19 is a schematic representation of super-element length randomization in accordance with exemplary embodiments of the invention.

FIG. 19 shows randomization in super-element length in accordance with exemplary embodiments of the invention. A first super-element SE has a selected length and a second super-element has a length that can vary by an amount DL. In an exemplary embodiment, the amount DL can vary, such as +/−ten percent of the length of the first super-element SE. In one embodiment, the length of super-elements in an array can vary randomly with a desired granularity, e.g., 0.5 percent of the length of the first super-element SE. In a further embodiment, the super-element length varies but in an ascending and/or descending configuration.

Exemplary embodiments of the present invention enable the reduction of peak sidelobe levels due to super-element grating lobes by randomizing the positions of the super-elements in a column-to-column basis. This arrangement does not generate an increase in cost for the array electronics or beamformer. In one embodiment, the array is built in groups of columns, e.g. eight, that are not shifted, but instead shift the column groups randomly with respect to each other. This will result in an increase in sidelobe level by 10 log K, where K is the size of the column group. In the example, the array has 632 columns, which should give a grating lobe reduction of approximately 28 db. As can be seen from FIG. 18, this is approximately correct. While super-elements are shown in exemplary embodiments as abutting each other, other embodiments include super-elements having an offset, from an end and/or side, of an adjacent super-element.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A phased array radar system, comprising:

an array comprising columns of constant-length super-elements containing radiator elements located along a length of the super-element, wherein the super-elements form the columns such that super-elements are arranged end-to-end, wherein the super-elements are arranged in the column at randomized locations to reduce sidelobes.

2. The system according to claim 1, wherein the column-to-column spacing is constant for at least part of the array.

3. The system according to claim 1, wherein the array is elliptically symmetric.

4. A phased array radar system, comprising:

an array comprising columns of super-elements containing radiator elements located along a length of the super-element, wherein the super-elements form the columns such that super-elements are arranged end-to-end, wherein the super-elements are arranged in the column at randomized locations to reduce sidelobes, wherein the length of the super-elements is randomized.

5. The system according to claim 4, wherein the length of the super-elements is randomized to a selected granularity.

6. A phased array radar system, comprising:

an array comprising columns of super-elements containing radiator elements located along a length of the super-element, wherein the super-elements form the columns such that super-elements are arranged end-to-end, wherein the super-elements are arranged in the column at randomized locations to reduce sidelobes, wherein the length of a first super-element is selected and a length of a second super-element is varied by a first amount added or subtracted from the length of the first super-element.

7. A phased array radar system, comprising:

an array comprising columns of super-elements containing radiator elements located along a length of the super-element, wherein the super-elements form the columns such that the super-elements are arranged end-to-end, wherein the length of the super-elements is randomized to reduce sidelobes such that the length of a first super-element is selected and a length of a second super-element is varied by a first amount added or subtracted from the length of the first super-element.

8. The system according to claim 7, wherein the length of the super-elements is randomized to a selected granularity.

9. A method, comprising:

providing an array including columns of constant-length super-elements containing radiator elements located along a length of the super-element, wherein the super-elements form the columns such that super-elements are arranged end-to-end; and arranging the super-elements in the columns at randomized locations to reduce sidelobes.

10. The method according to claim 9, wherein the column-to-column spacing is constant for at least part of the array.

11. The method according to claim 9, wherein the array is elliptically symmetric.

12. A method, comprising:

providing an array including columns of super-elements containing radiator elements located along a length of the super-element, wherein the super-elements form the columns such that super-elements are arranged end-to-end; and arranging the super-elements in the columns at randomized locations to reduce sidelobes, wherein the length of a first super-element is selected and a length of a second super-element is varied by a first amount added or subtracted from the length of the first super-element.

13. A phased array radar system, comprising:

a means for receiving and/or transmitting radar signals comprising an array including columns of constant-length super-elements containing radiator elements arranged in the columns at randomized locations to reduce sidelobes.

* * * * *